United States Patent [19]

Fischer

[11] 4,029,441

[45] June 14, 1977

[54] TUBING MEANS FOR ROLLER PUMP

[75] Inventor: Lorenz Fischer, Kriens, Switzerland

[73] Assignee: Sermem S.A., Sion, Switzerland

[22] Filed: Apr. 22, 1975

[21] Appl. No.: 570,474

[30] Foreign Application Priority Data

Apr. 24, 1974 Switzerland ..... 5610/74
Apr. 24, 1974 Switzerland ..... 5611/74

[52] U.S. Cl. ..... 417/477; 417/478; 138/156

[51] Int. Cl.[2] ..... F04B 43/08; F04B 45/06

[58] Field of Search ..... 417/474, 475, 476, 477, 417/478; 138/156, 165, 166

[56] References Cited

UNITED STATES PATENTS

| | | | |
|---|---|---|---|
| 431,028 | 7/1890 | Bayles | 138/156 |
| 2,113,824 | 4/1938 | Bresee | 138/156 X |
| 2,987,004 | 6/1961 | Murray | 417/477 |
| 3,455,336 | 7/1969 | Ellis | 138/156 |
| 3,565,554 | 2/1971 | Muller | 417/477 |
| 3,587,657 | 6/1971 | Staller | 138/156 |
| 3,875,970 | 4/1975 | Fitter | 417/477 |
| R24,613 | 3/1959 | Hageltorn | 138/156 X |

*Primary Examiner*—Carlton R. Croyle
*Assistant Examiner*—Thomas I. Ross
*Attorney, Agent, or Firm*—Dorfman, Herrell and Skillman

[57] ABSTRACT

A volumetric pump comprising a flexible conduit and roller means for collapsing the conduit to pump liquid therethrough. The conduit is formed to provide a projecting rib to anchor the conduit to an underlying support device. The conduit is formed by forming a flat elastomeric sheet into tubular form, the opposite side edges of the sheet having flanges which are disposed into abutting relation to form the anchoring rib. Preferably, the sheet has a reinforcement imbedded centrally therein. The support may include jaws for clamping the two flange members into abutting relation and saddle elements to insure the desired pumping action by the rollers as they are advanced along the tubular member.

14 Claims, 5 Drawing Figures

TUBING MEANS FOR ROLLER PUMP

This invention relates to a volumetric pump comprising inlet and outlet couplings, a flexible suction and delivery member, a support device for supporting that member, and a mobile arrangement cooperating with the support device for effecting a localized constriction of the member while moving cyclically along it.

Volumetric pumps of the flexible-tube peristaltic type are used for drawing in, delivering, and sometimes measuring out fluid substances of various kinds. Their suction and delivery member is a tube made of an elastomer which is subjected to extensive and repeated deformation during use. In particular, this tube is subjected to cyclical crushing at a rapid rate, which requires it to have high-strength mechanical properties.

In the past, such tubes have generally been produced by molding with a view to facilitating their manufacture and especially for the purpose of forming on the tube certain auxiliary operating appendages, such as a centering ridge and an end flange to rest against the body of the pump. A molded part of this kind requires the use of a two-part mold and a core, which results in burrs and seams and, consequently, points of weakness situated precisely in those areas which are most subject to stress.

Moreover, if it is desired to strengthen such a molded tube by embedding a reinforcement within the mass, it cannot be molded without causing the reinforcement to shift; this generally means that the reinforcement is considerably off-center, thus creating a weakness which defeats the purpose. This phenomenon occurs when the fluid rubber enclosed within the mold moves out towards the seams. Hence the flexible tubes for volumetric pumps are costly and not very reliable.

It is the object of this invention to remedy these drawbacks and, more particularly, to provide a volumetric pump with a flexible suction and delivery member having a longer life and increased reliability, yet a lower cost-price than the tubes used heretofore.

To this end, in the volumetric pump according to the present invention, the suction and delivery member is a flat, elastomeric section comprising two ends, two parallel side edges, and two securing appendages disposed along these edges, the appendages being fixed to the support device for keeping the section bent back upon itself, and the two ends being respectively connected in a fluid-tight manner to the inlet and outlet couplings.

Figure 1:
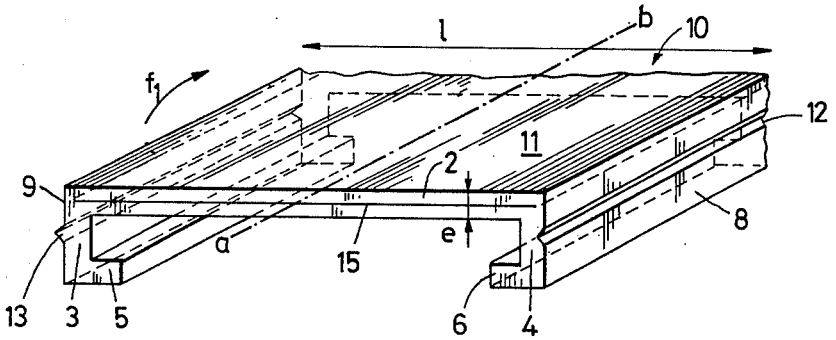
Figure 2:
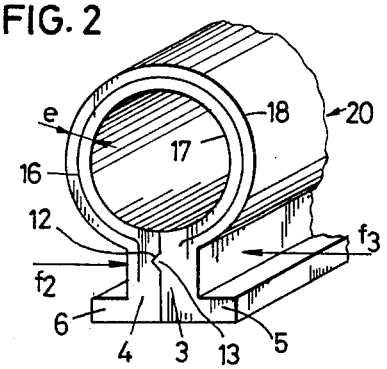
Figure 4:
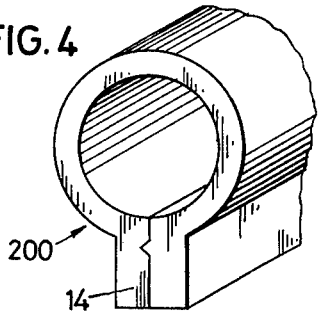
Figure 3:
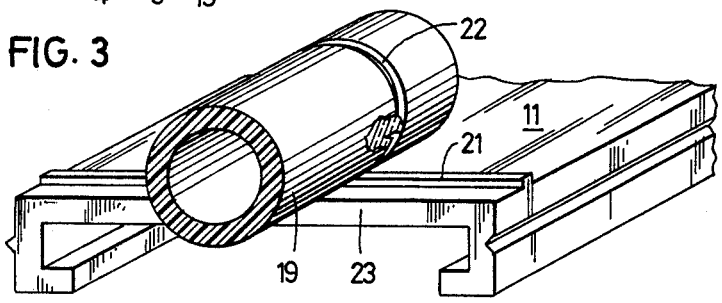
Figure 5:
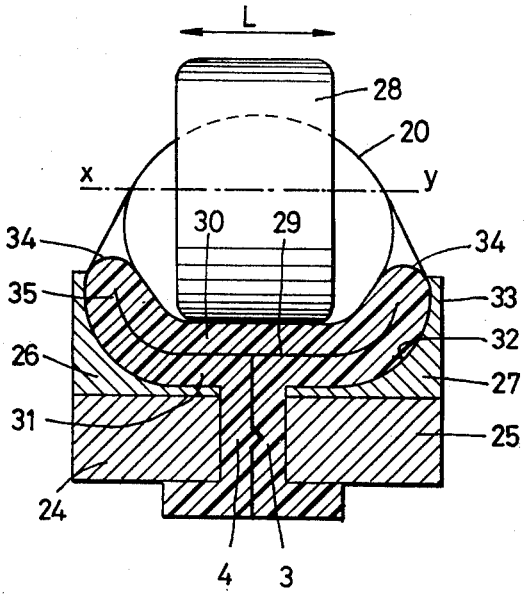

A preferred embodiment of the invention and a variation thereof will now be described in detail with reference to the accompanying drawings, in which:

FIG. 1 is a partial isometric projection view of a flat, elastomeric section intended to form the suction and delivery member of the pump, FIG. 2 is a partial isometric projection view of the suction and delivery member while held in its assembled state, the gripping means of the support device not being shown, FIG. 3 is a partial isometric projection view illustrating the means for connecting the suction and delivery member to the inlet and outlet couplings of the pump, FIG. 4 is a view similar to FIG. 2, showing a variation of the suction and delivery member, and FIG. 5 is a vertical section through the support device and the suction and delivery member, also showing a roller of the drive mechanism.

Generally speaking, this flexible-tube volumetric pump comprises a stator, the essential part of which is a support device 24, 25, 26, 27 (FIG. 5) that supports a suction and delivery member 20. Facing the stator of the pump is a mobile arrangement comprising one or more rollers 28 or, as the case may be, runners, the rollers 28 being driven along a closed circuit so as to come in contact with the member 20 at a certain point during each cycle and to move in contact with the member 20, creating a localized contraction moving from the suction-side end towards the delivery-side end.

The stator and the mobile arrangement may be differently disposed according to the embodiment. The mobile arrangement may be a rotor, in which case the rollers 28 describe a circular path, and both the support device 24–27 and the member 20 extend along an arc of a circle concentric with the rotor. At their ends, they diverge at a tangent to the rotor to allow the member 20 to be connected to inlet and outlet couplings. In other embodiments, however, the device 24–27 and the member 20 are disposed in a straight line, and the mobile arrangement comprises a drive mechanism, e.g., a chain drive, which moves the rollers 28 along a partially straight path, the action of the rollers 28 on the member 20 having the same effect as in the circular rotor arrangement. The pump described below is of the latter kind, although the essential features of the invention relating to the support device and the suction and delivery member may be used with either one of the possible arrangements.

The suction and delivery member of the pump being described is a section (FIG. 1) designated as a whole by the reference numeral 10. It comprises a substantially plane region 2, of a thickness $e$ and a width $l$, from the side edges of which two appendages 3 and 4 project at a 90° angle. The appendages 3 and 4 may, if so desired, end in two angle-brackets 5 and 6 projecting towards the inside of the section 10; the use of the angle-brackets 5 and 6 will be explained further on. Thus the section 10 need not necessarily have any mold seam in its central region 2.

It will be seen that the appendage 4 comprises on its outer surface 8 a longitudinal groove 12 positioned at a 90° angle to the surface 11 of the region 2. On the other side of the section 10, the appendage 3 comprises on its outer surface 9 a rib 13 positioned at a 90° angle to the surface 11.

The purpose of the groove 12 and the rib 13 is to ensure proper centering of the wall of the tube and to ensure that the tube is fluid-tight by fitting into one another hermetically when the section 10 is bent back upon itself in the direction of arrow $f_1$ (FIG. 1), as it appears in FIG. 2. It then suffices to press the appendages 3 and 4 against one another by means of a support device, in the form of a vise or an equivalent device, exerting upon them two opposing forces $f_2$ and $f_3$ to form, by means of the section 10, a tube designated as a whole by the numeral 20. It is noted that in FIG. 1 the rib 13 is slightly larger in cross-section than the groove 12, both being triangular in cross-section. The jaws of the vise may advantageously be accommodated between the angle-brackets 5, 6 and the body of the tube 20; but it is obvious that without departing from the overall concept of the invention, the bent-back tube may be closed on simple appendages 14 without angle-brackets, as shown in FIG. 4 and designated by the numeral 200.

When the section 10 is being molded, a reinforcement 15 made, for example, of nylon, cotton, or metal fabric, and placed between two calendered sheets before molding, may advantageously be embedded in the thickness *e* of the region 2. After bending of the section 10, the reinforcement 15 becomes quite naturally situated at 16, embedded within the wall of the tube 20. This feature is very advantageous for reinforcing the elasticity of the tube 20 and enabling it better to withstand the effects of pressure which a volumetric pump may be called upon to overcome. It is not possible, however, to obtain a reinforcement correctly embedded in a tube molded by compression between two mold-parts according to the prior art.

Another important advantage of the tube 20 for its application to volumetric pumps is the prestressed condition of tension and of internal compression of the bent-back tube. In that form, as a matter of fact, the central region 17 of the thickness *e* is highly compressed, while the peripheral region 18 is in a state of tension; this is doubly favorable for facilitating the return of the flexible tube 20 to its original cross-section after the mobile pumping member has passed. Thus it will be noted that, the thicknesses being equal, the suction performance of the flexible tube 20 is improved as compared with the tubes of the prior art.

Taking into account the type of mold used to produce it, a section such as the section 10 may be made of most elastomeric materials and give satisfactory results.

As a consequence of the two advantageous features indicated above as compared with the prior art tubes, the member 10 will have a thickness *e* which is less than that of the corresponding prior art tube, and consequently less mass. Now it is a known fact that in the operation of a volumetric pump with a flexible tube acted upon by a mobile member, for example, the less the mass of rubber deformed by the mobile member, the less heat is generated, the more durable the retention of the mechanical characteristics, and consequently, the longer the operating life of the tube.

In order to connect the tube 20 to a coupling 19 at the end of a duct communicating with the pump, provision may be made, for example, for a rib 21 situated at each end of the section 10 about 1 cm. from the end edge 23; each rib 21 projects from the surface 11 perpendicular to the longitudinal axis *a-b* of the section 10 and, upon assembly, fits into a corresponding groove 22 cut into the end of the coupling 19, as may be seen in FIG. 3, so as to ensure a fluid-tight male-female connection.

The profiles of the ribs 13 and 21, as well as those of the corresponding grooves 12 and 22, respectively, may, for example, be triangular or rectangular in cross-section, and the male profile may be slightly reinforced as compared with the female profile.

The support device 24, 25, 26, 27 which squeezes the appendages 3 and 4 together and keeps the section 10 bent is shown in FIG. 5. Also shown there is a roller 28 forming part of the mobile arrangement of the pump. The roller 28 is rotatable about an axis *x-y* while carrying out a translatory motion in the direction perpendicular to the plane of FIG. 5. It flattens the suction and delivery member 20 and defines within that member, in a manner known per se, a suction region and a delivery region separated by a substantially fluid-tight construction region 29. The roller 28, which is cylindrical in shape, has a bearing generatrix of a length L taking up about half the width of the tube 20 when it is completely flattened out. Thus the roller 28 flattens only the middle region of the tube 20, pressing an upper portion 30 against a lower portion 31. The appendages 3 and 4 are centered longitudinally and secured to the support device by jaws 24 and 25 of a vise which keeps the suction and delivery member 20 bent back upon itself in the form of a tube. Disposed between the jaws 24, 25 and the cylindrical portion of the member 20 are elements 26 and 27, each having the inner shape of a half-trough, and the upper profiles 32 of which are provided with rims 33 for raising up the pinched edges 34 of the member 20 which are not in contact with the roller 28. The raised edges 34 are bent back towards the roller 28 and automatically ensure the closing of the lips 35 of the bent-back member and their fluid-tightness without harmful overpressure by the roller 28. Thus the elements 24, 25, 26, 27 of the support device hold the suction and delivery member 20 securely in place and cooperate with the rollers 28 which effect localized squeezing of that member while travelling along its length to ensure the suction and delivery of the liquid.

The jaws 24 and 25 which act as a support for the member 20, on the one hand, and which press the appendages 3 and 4 together, on the other hand, are connected to one another by a traction device known per se which need not be described here.

It is not indispensable, however, for the securing appendages of the flat section to be pressed together. In other embodiments, they may be secured independently of one another to a single sole-piece forming part of the support device and, at the same time, constituting part of the suction and delivery member.

What is claimed is:

1. A volumetric pump comprising inlet and outlet couplings, each of said couplings having a circumferential groove therein, a flexible suction and delivery member, a support device for supporting said member, and a mobile arrangement cooperating with said support device for effecting a localized constriction of said member while moving cyclically along it, wherein said member is a flat, elastomeric section comprising two ends, two parallel side edges, and two securing appendages disposed along said edges, said appendages being fixed to said support device for keeping said section bent back upon itself in tubular form, the inner surface of said section having a rib parallel to and adjacent each of said two ends, and said two ends being respectively connected in a fluid-tight manner to said inlet and outlet couplings with said ribs respectively engaging in said grooves.

2. A pump in accordance with claim 1, wherein respective faces of said appendages are kept pressed against one another by said support device.

3. A pump in accordance with claim 2, wherein said support device comprises gripping jaws for keeping said faces pressed against one another.

4. A pump in accordance with claim 2, wherein one of said faces comprises a longitudinal groove, the other of said faces comprises a longitudinal rib, and said rib is engaged in said groove for ensuring the centering and the fluid-tightness of said member.

5. A pump in accordance with claim 4, wherein said rib is slightly larger in cross-section than said groove.

6. A pump in accordance with claim 5, wherein the cross-sections of said rib and said groove are triangular.

7. A pump in accordance with claim 4, wherein said rib and said groove are each situated at the same distance from the inner surface of said member for ensuring that said member is maintained in a tubular shape.

8. A pump in accordance with claim 3, wherein each said appendage comprises an edge having an element in the shape of an angle-bracket disposed along it, and said elements are engaged under said jaws.

9. A pump in accordance with claim 1, wherein said section comprises a central portion having a reinforcement embedded therein.

10. A volumetric pump comprising inlet and outlet couplings, a flexible suction and delivery member, a support device for supporting said member, a mobile arrangement cooperating with said support device for effecting a localized constriction of said member while moving cyclically along said member, wherein said member is a flat-formed elastomeric section comprising two ends, two parallel side edges, and two securing appendages disposed along said edges, said section being bent back upon itself in the shape of a tube, said appendages having confronting faces pressed fluid-tightly against one another by said support device for keeping said section bent back upon itself, one of said faces including a longitudinal groove and the other of said faces including a longitudinal rib engaging in said groove for ensuring the centering and fluid-tightness of said tube, and said two ends being respectively, connected in a fluid-tight manner to said inlet and outlet couplings.

11. A pump in accordance with claim 10 wherein said flat-formed elastomeric section has a reinforcement fabric extending between said side edges and molded therein equidistant between the interior and exterior surfaces of the tube formed by said section.

12. A pump in accordance with claim 10 wherein said rib is slightly larger in cross-section than said groove.

13. A pump in accordance with claim 12 wherein the cross-sections of said rib and said groove are triangular.

14. A pump in accordance with claim 10 wherein said rib and said groove are each situated at the same distance from the inner surface of said member for ensuring that said member is maintained in a tubular shape.

* * * * *

UNITED STATES PATENT OFFICE

CERTIFICATE OF CORRECTION

Patent No. 4,029,441 Dated June 14, 1977

Inventor(s) Lorenz Fischer

It is certified that error appears in the above-identified patent and that said Letters Patent are hereby corrected as shown below:

Column 3, line 33, "member 10" should be --member 20--;

Column 3, lines 66,67 "construction" should be --constriction--.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*